US009673547B2

(12) United States Patent
Saka et al.

(10) Patent No.: US 9,673,547 B2
(45) Date of Patent: Jun. 6, 2017

(54) PLATED TERMINAL FOR CONNECTOR AND TERMINAL PAIR

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventors: Yoshifumi Saka, Yokkaichi (JP); Hajime Watanabe, Yokkaichi (JP); Mikio Satou, Yokkaichi (JP); Masayuki Ookubo, Yokkaichi (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 42 days.

(21) Appl. No.: 14/395,906

(22) PCT Filed: May 9, 2013

(86) PCT No.: PCT/JP2013/063038

§ 371 (c)(1),
(2) Date: Oct. 21, 2014

(87) PCT Pub. No.: WO2013/168764

PCT Pub. Date: Nov. 14, 2013

(65) Prior Publication Data

US 2015/0133005 A1 May 14, 2015

(30) Foreign Application Priority Data

May 11, 2012 (JP) ..... 2012-109628
Mar. 18, 2013 (JP) ..... 2013-055085

(51) Int. Cl.
*H01R 13/03* (2006.01)
*C25D 7/00* (2006.01)
(Continued)

(52) U.S. Cl.
CPC ..... *H01R 13/03* (2013.01); *C25D 7/00* (2013.01); *C25D 3/60* (2013.01); *C25D 5/12* (2013.01)

(58) Field of Classification Search
None
See application file for complete search history.

(56) References Cited

U.S. PATENT DOCUMENTS

2010/0163276 A1 7/2010 Yamaguchi et al.
2010/0186993 A1 7/2010 Yamaguchi et al.
(Continued)

FOREIGN PATENT DOCUMENTS

JP 08-171954 7/1996
JP 10-046363 2/1998
(Continued)

OTHER PUBLICATIONS

JEITA RC-5241 With English Translation.
(Continued)

*Primary Examiner* — Adam Krupicka
(74) *Attorney, Agent, or Firm* — Gerald E. Hespos; Michael J. Porco; Matthew T. Hespos

(57) ABSTRACT

The present invention aims to provide a plated terminal for connector which requires a smaller insertion force by reducing a friction coefficient and a terminal pair formed using such a plated terminal for connector. An alloy containing layer (1) made of tin and palladium and containing a tin-palladium alloy is formed on a surface of a terminal base material (2) made of copper or copper alloy. Here, the alloy containing layer (1) is preferably such that domain structures of a first metal phase (11) made of an alloy of tin and palladium are formed in a second metal phase (12) made of pure tin or an alloy having a higher ratio of tin to palladium than in the first metal phase (11).

19 Claims, 6 Drawing Sheets

(51) Int. Cl.
*C25D 3/60* (2006.01)
*C25D 5/12* (2006.01)

(56) References Cited

U.S. PATENT DOCUMENTS

| | | | | |
|---|---|---|---|---|
| 2012/0107639 | A1* | 5/2012 | Takamizawa | C25D 5/10 428/620 |
| 2013/0043875 | A1* | 2/2013 | Chen | G01R 31/2648 324/414 |

FOREIGN PATENT DOCUMENTS

| | | |
|---|---|---|
| JP | 11-193494 | 7/1999 |
| JP | 2002-005141 | 1/2002 |
| WO | 2008123259 | 10/2008 |

OTHER PUBLICATIONS

Katja Reiter, Mario Reiter, Thomas Ahrens, Special aspects of the metallographic prepartion of electronic and microelectronic devices. Structure 34, pp. 12-20, (available on-line Mar. 18, 2003), Struers DE.

* cited by examiner

PLATED TERMINAL FOR CONNECTOR AND TERMINAL PAIR

BACKGROUND OF THE INVENTION

1. Field of the Invention

The present invention relates to a plated terminal for connector, more particularly to a plated terminal for connector including an alloy plating layer, and a terminal pair formed by using such a plated terminal.

2. Description of the Related Art

Copper and copper alloy having high electrical conductivity, good ductility and appropriate strength are used for electrically conductive members used such as in electrical connection terminals. Since insulating films such as oxide films and sulfide films are formed on surfaces of these, contact resistance is high at the time of contact with other conductors. Accordingly, a terminal formed by applying tin plating 21 to a surface of a base material 22 such as copper or copper alloy as shown in FIG. 7(*b*) has been conventionally generally used as a connector terminal for connecting an electrical component or the like of an automotive vehicle. For example, a connector terminal including a tin plating layer is described in Japanese Unexamined Patent Publication No. H10-46363. As compared with other metals, tin is characterized by being very soft. In a tin plated terminal, a relatively hard insulating tin oxide film is formed on a surface of a metal tin layer. However, since the tin oxide film is destroyed with a weak force and the soft tin layer is easily exposed, good electrical contact is established.

In the connector terminal formed with the tin plating layer, good electrical contact can be established as described above due to the softness of tin, whereas there is a problem of a high friction coefficient at the time of terminal connection likewise due to the softness of tin. As shown in FIG. 7(*b*), on the surface of the soft tin plating layer 21, the tin layer 21 is easily dug up and easily adheres to itself when a connector contact slides. This increases the friction coefficient of the surface of the tin plating layer 21 and increases a force necessary to insert the connector terminal (insertion force). Particularly, in the case of using tin plating for terminals of a multi-pole fitting connector including many terminals, the insertion force becomes larger as the number of the terminals increases and a connecting operation becomes difficult.

The present invention aims to provide a plated terminal for connector and a terminal pair having a lower friction coefficient than a tin plated connector terminal.

SUMMARY OF THE INVENTION

To solve the above-described problem, a plated terminal for a connector according to the invention has a base material made of copper or copper alloy and an alloy containing layer formed on a surface of a base material. The alloy containing layer is made of tin and palladium and contains a tin-palladium alloy.

The content of palladium in the alloy containing layer is preferably not lower than 1 atom %.

The content of palladium in the alloy containing layer is preferably below 20 atom %.

The alloy containing layer is preferably such that domain structures of a first metal phase made of an alloy of tin and palladium are formed in a second metal phase made of pure tin or an alloy having a higher ratio of tin to palladium than in the first metal phase.

An exposed surface ratio of the first metal phase on a surface of the alloy containing layer is preferably not lower than 10%.

The exposed surface ratio of the first metal phase on the surface of the alloy containing layer is preferably not higher than 80%.

The glossiness of the surface of the connector terminal is preferably in a range of 10 to 300%.

A thickness of the alloy containing layer is preferably not smaller than 0.8 μm.

A dynamic friction coefficient when surfaces of the alloy containing layers are rubbed against each other is preferably not higher than 0.4.

A Vickers hardness of the alloy containing layer is preferably not lower than 100.

A domain of the first metal phase having a dimension shorter than the longest one of straight lines crossing a contact portion to be brought into electrical contact with another electrically conductive member is preferably exposed on a surface of the contact portion.

The contact portion is preferably in the form of an embossment. A radius of the embossment is preferably not smaller than 3 mm.

A terminal pair according to the present invention includes a male connector terminal and a female connector terminal, wherein at least one of the male and female connector terminals is formed by the above plated terminal for connector.

A contact load applied to a contact portion where the male and female connector terminals come into contact with each other is preferably not lower than 2 N, further preferably not lower than 5 N.

The plating layer of the above-described terminal for connector is unlikely to be dug up or adhere to itself at a connector contact since the tin-palladium alloy containing layer having high hardness is formed on the surface of the base material. This reduces a friction coefficient of the surface and suppresses a terminal insertion force.

The friction coefficient is reduced more effectively if the composition, structure, dynamic friction coefficient and hardness of the alloy containing layer are specified as described above. Particularly, since the first metal phase made of the alloy of tin and palladium has a high effect in reducing the friction coefficient, the friction coefficient of the connector contact portion is effectively reduced by setting the exposed surface ratio of the first metal phase on the surface of alloy containing layer at 10% or higher.

On the other hand, since the second metal phase made of pure tin or the alloy having a higher ratio of tin to palladium than in the first metal phase has low contact resistance, it is possible to suppress contact resistance of the connector contact portion and establish good electrical contact by setting the exposed surface ratio of the first metal phase on the surface of the alloy containing layer at 80% or lower. This can combine a reduction of the friction coefficient and the ensuring of connection reliability. The glossiness of the surface measurable by a simple method and having a good correlation to the exposed surface ratio of the first metal phase may be used as an index for obtaining such a connector terminal capable of combining a low friction coefficient and high connection reliability.

If a domain of the first metal phase having a shorter dimension than the longest one of straight lines crossing the contact portion to be brought into electrical contact with another electrically conductive member is exposed on the surface of the contact portion, both the first metal phase and the second metal phase are exposed in the contact portion.

Thus, an effect of reducing the friction coefficient by the first metal phase and an effect of reducing contact resistance by the second metal phase can be simultaneously enjoyed. Particularly, if the contact portion is in the form of an emboss instead of in the form of a flat plate, further if a radium of that emboss is not smaller than 3 mm, the effect of reducing the friction coefficient is increased.

According to the terminal pair of the above invention, a force necessary to insert the terminal is suppressed since the tin-palladium alloy containing layer having high hardness is formed on the surface of either one of the male and female connector terminals to reduce the friction coefficient of the surface.

If a contact load applied to the contact portion where the male and female connector terminals come into contact with each other is not lower than 2 N, an oxide film formed on the surface of the second metal phase can be broken to establish electrical conduction between the both terminals. Thus, a good electrical connection property of the second metal phase can be effectively utilized. Further, if the contact load is not lower than 5 N, the effect of reducing the friction coefficient is greatly increased.

DETAILED DESCRIPTION

A plated terminal for connector according to the present invention (hereinafter, may be merely referred to as a plated terminal or a connector terminal) is such that a tin-palladium alloy containing layer 1 (hereinafter, may be merely referred to as an alloy containing layer) is formed on a surface of a base material 2 as shown in a cross-sectional configuration in FIG. 1. The alloy containing layer 1 is formed at least on a part of the connector terminal for connector to be brought into contact with a mating terminal.

The base material 2 is a base material of the connector terminal and made of copper or copper alloy. The tin-palladium alloy containing layer 1 may be directly formed on the base material 2 as shown in FIG. 1(*a*) or may be formed after an under plating layer 3 made of nickel or nickel alloy is formed on the surface of the base material 2 as shown in FIG. 1(*b*). The under plating layer 3 has an effect of suppressing the diffusion of copper atoms from the base material 2 into the alloy containing layer 1.

Figure 7A:
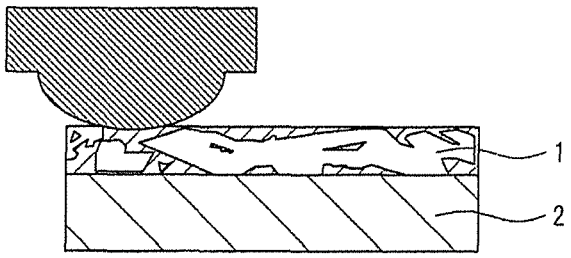
FIGS. 7(*a*) and 7(*b*) are diagrams showing the structure of a connector contact portion, wherein FIG. 7(*a*) shows the case of a tin-palladium plated terminal according to the present invention and FIG. 7(*b*) shows the case of a conventional tin plated terminal.
Figure 7B:
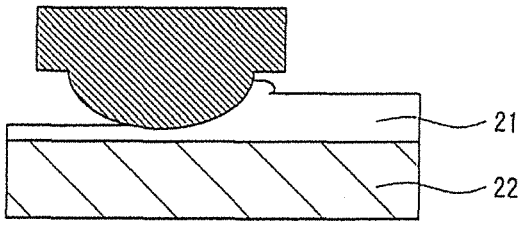

Because palladium has very high hardness, the tin-palladium alloy containing layer 1 has high hardness. This causes a plated terminal surface to have a low friction coefficient. That is, even if the surface is rubbed as shown in FIG. 7(*a*), the hard alloy containing layer 1 is not easily dug up or does not easily adhere to itself. In this way, an insertion force for the plated terminal is suppressed.

Further, to effectively achieve a reduction of the friction coefficient, the content of palladium of the entire tin-palladium alloy containing layer 1, i.e. the entire area of the tin-palladium alloy containing layer 1 combining alloy parts 11 and a tin part 12 to be described later is preferably not lower than 1 atom %.

If the content of palladium in the entire area of the tin-palladium alloy containing layer 1 is not lower than 4 atom %, the friction coefficient is further effectively reduced.

Further, the tin-palladium alloy is known to form a stable intermetallic compound called PdSn4. In terms of forming this intermetallic compound in the tin-palladium alloy containing layer 1, the content of palladium is preferably not higher than 20 atom %.

An upper limit value of the content of palladium is more preferably 7 atom %. Even if more than 7 atom % of palladium is contained in the tin-palladium alloy containing layer 1, an effect in increasing hardness and reducing the friction coefficient tends to saturate. Further, if the content of palladium is high, heating is necessary to reach a high temperature for sufficient alloying between tin and palladium.

Figure 1A:
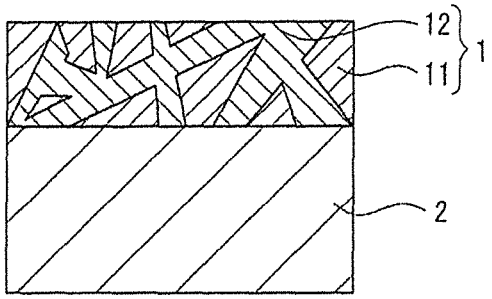
FIGS. 1(*a*) and 1(*b*) are schematic diagrams showing a cross-section of a tin-palladium alloy plated terminal, wherein FIG. 1(*a*) shows a case where a tin-palladium alloy containing layer is formed on a base material made of copper alloy and FIG. 1(*b*) shows a case where a nickel underlayer is additionally provided.
Figure 1B:
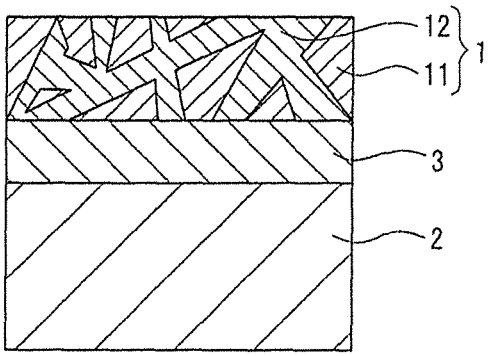

If the content of palladium in the tin-palladium alloy containing layer 1 is below 20 atom %, the entire tin-palladium alloy containing layer 1 is not made of an alloy with uniform composition, but is composed of the alloy parts 11 (first metal phase) in which tin and palladium form an alloy at a fixed composition ratio and the tin part 12 (second metal phase) made of pure tin or an alloy having a higher ratio of tin than in the alloy parts 11 as shown in FIG. 1. The alloy parts 11 are segregated in the tin part 12 to form three-dimensional domain-like (island-like, cluster-like) structures.

For example, even if the entire tin-palladium alloy containing layer 1 is formed of a tin-palladium alloy having the same composition as the alloy parts 11, it is considered possible to obtain an effect of reducing the friction coefficient. However, since the alloy parts 11 made of the hard tin-palladium alloy are formed in a domain state as parts of the alloy containing layer 1, it is possible to achieve a sufficiently low friction coefficient with lower material cost and production cost than when the entire alloy containing layer 1 is formed of the tin-palladium alloy.

In this sense, if an exposed surface ratio of the alloy parts 11 on the surface of the alloy containing layer 1 (hereinafter, merely referred to as an exposed surface ratio of the alloy parts 11) is not lower than 10%, a reduction of the friction coefficient is effectively achieved, which is preferable. If the exposed surface ratio of the alloy parts 11 is not lower than 30%, it is further effective. Note that the exposed surface ratio of the alloy parts 11 is calculated as (area of the alloy parts 11 exposed on the surface)/(area of the entire surface of the alloy containing layer 1)×100(%).

Further, to effectively enjoy a friction coefficient reducing action by the hardness of the tin-palladium alloy, the tin-palladium alloy containing layer 1 preferably has a thickness of 0.8 μm or larger in the plated terminal.

In view of application as an on-vehicle connector terminal, a dynamic friction coefficient when surfaces of alloy containing layers 1 are slid against each other is preferably not higher than 0.4. More preferably, the dynamic friction coefficient is not higher than 0.3. Generally, the friction coefficient tends to decrease with an increase in the hardness of a material, but a Vickers hardness of the alloy containing layer 1 is preferably not lower than 100. Precious metals including palladium generally have a property of easily adhering to themselves. If the tin-palladium alloy containing layer has a high Vickers harness of 100 or higher, an effect of reducing the dig-up and adhesion by hardness is thought to exceed an adhesive property of palladium and a low friction coefficient is thought to be achieved as a whole.

Further, in view of application of the connector terminal as an electrically conductive member, a contact portion of the connector terminal to be electrically brought into contact with another electrically conductive member preferably has a low friction coefficient and, in addition, contact resistance thereof is suppressed to a low value. Since tin has very low volume resistivity and is soft and an oxide film formed on a surface is easily destroyed, low contact resistance is given and good electrical contact is established by coating the contact portion of the connector terminal with tin. The tin part 12 forming the alloy containing layer 1 is made of pure tin or an alloy having a higher ratio of tin than in the alloy parts 11. Thus, by being exposed on the surface of the alloy containing layer 1, it is possible to suppress the contact resistance of the contact portion of the connector terminal to a low value and provide high connection reliability by the properties of tin as described above. Accordingly, if the exposed surface ratio of the alloy parts 11 on the surface of the alloy containing layer 1 is set not higher than 80%, the contact resistance of the contact portion of the connector terminal can be effectively suppressed.

As just described, since the alloy parts 11 exposed on the surface of the alloy containing layer 1 are highly effective in reducing the friction coefficient and the tin part 11 is highly effective in suppressing the contact resistance, the effect of reducing the friction coefficient and the effect of suppressing the contact resistance can be simultaneously enjoyed if both the alloy parts 11 and the tin part 12 are exposed on the surface of the contact portion of the connector terminal. If a dimension of a domain of the alloy part 11 exposed on the surface (length of the longest straight line crossing the domain) is shorter than a long diameter of the contact portion, i.e. a length of the longest one of straight lines crossing the contact portions, both the alloy part 11 and the tin part 12 are reliably exposed on the surface of the contact portion, which is preferable.

By specifying the exposed surface ratio of the alloy parts 11, the reduction of the friction coefficient and the suppression of the contact resistance can be combined. Since the alloy parts 11 are exposed on the surface of the alloy containing layer 1 while forming fine domain structures, surface observation using an electronic microscope, a probe microscope or the like is necessary to estimate an exposure ratio thereof, which requires high cost and effort. Accordingly, using the glossiness of the surface of the alloy containing layer 1, which is a macroscopic parameter having a high correlation to the exposure ratio of the alloy parts 11, as an index, a low friction coefficient and low contact resistance can be more conveniently ensured. The alloy parts 11 have a lower reflectance than the tin part 12 and the glossiness of the surface of the alloy containing layer 1 decreases with an increase in the exposed surface ratio of the alloy parts 11.

Specifically, if the glossiness of the surface of the alloy containing layer 1 is in a range of 10 to 300%, the reduction of the friction coefficient and the suppression of the contact resistance can be highly combined. Here, the glossiness conforms to JIS Z 8741-1997 and is based on mirror surface glossiness at an incident angle θ specified on a glass surface having a refractive index of 1.567 and expressed with this value set as 100%. Here, a measurement is conducted with a measurement angle (incident angle) θ=20°.

Note that, in the case of use as an on-vehicle terminal, the plated terminal is desirably heat resistant, i.e. an increase of a contact resistance value after subjection to a high-temperature environment is suppressed since a use environment is hot and heat may be generated due to electrical conduction. In the plated terminal according to the present invention formed with the tin-palladium alloy containing layer 1, an increase of the contact resistance value after subjection to heating is suppressed substantially to the same level as conventional tin plated terminals.

An increase of the contact resistance value caused by heating tends to become larger when a hard plating layer is formed on a terminal surface than when a soft plating layer is formed. This is because a plating layer alloyed with a base material and an underplating such as nickel is hardened by heating and, in addition, oxide films of tin and its alloy formed on an outer surface of the hardened plating layer are not easily destroyed. The tin-palladium alloy containing layer 1 has a resistance value increase caused by heating, which is suppressed substantially to the same level as soft tin plating layers, although being very hard as described above. This is thought to be because even if a tin oxide film is formed on a part of the surface by heating, palladium as a precious metal is difficult to oxidize and electrical conduction is easily established from the outermost surface to the inside of the alloy containing layer 1 and the base material 2.

How to form the tin-palladium alloy containing layer 1 does not matter. For example, the alloy containing layer 1 can be formed by laminating a tin plating layer and a palladium plating layer on the surface of the base material 2 or the surface of the under plating layer 3 and allowing them to alloy by heating. Alternatively, the alloy containing layer 1 may be formed by codeposition using plating liquid containing both tin and palladium. In terms of convenience, the former method for allowing the tin plating layer and the palladium plating layer to alloy after laminating them is preferable. By adjusting a heating temperature and a heating time during the alloying, it is possible to control the exposed surface ratio of the alloy parts 11 and the dimensions of the domains of the alloy parts 11. The domains of the alloy parts 11 grow larger as the alloying is performed at a higher temperature and for a longer time.

The plated terminal for connector including the above tin-palladium alloy containing layer 1 may be formed as a male connector terminal or as a female connector terminal. A terminal pair according to the embodiment of the present embodiment is a pair of a male connector terminal and a female connector terminal. Either one of the male and female connector terminals may include the alloy containing layer 1 or both of them may include the alloy containing layer 1. An effect of reducing a terminal insertion force by reducing the friction coefficient is more easily obtained when both the male and female connector terminals include the alloy containing layer 1 than when either one of them includes the alloy containing layer 1.

A terminal pair in which a female connector terminal is formed with an emboss-like contact portion and this emboss portion slides on a surface of a flat plate-like male connector terminal tab for connection is often used. In this case, if the female connector terminal is formed with the alloy containing layer 1, the effect of reducing the friction coefficient can be exhibited if the alloy containing layer 1 is formed at least on a surface of the emboss-like contact portion. On the other hand, if the male connector terminal is formed with the alloy containing layer 1, it is preferable in enjoying the effect of reducing the friction coefficient over the entire sliding area that the alloy containing layer 1 is formed on the entire area of the flat plate-like terminal tab on which the emboss-like contact portion of the female connector terminal slides.

As just described, the above tin-palladium alloy containing layer 1 can provide the effect of reducing the friction coefficient even if it is formed on the emboss-like contact portion or the flat plate-like contact portion. The effect of reducing the friction coefficient is larger when the tin-palladium alloy containing layer 1 is formed on the emboss-like contact portion, particularly when a radium of the emboss is large. That is, if the tin-palladium alloy containing layer 1 is formed only on either one of the female contact terminal including the emboss-like contact portion and the male connector terminal including the flat plate-like terminal tab, the effect of reducing the friction coefficient is larger when the tin-palladium alloy containing layer 1 is formed on the female connector terminal, particularly when the radius of the emboss radius of the contact portion is large.

Further, a round shape of the emboss on which the tin-palladium alloy containing layer 1 is formed (radius when the emboss is approximated to a hemispherical shape) is not smaller than 3 mm, the effect of reducing the friction coefficient becomes even larger as compared with the case where a tin plating layer is formed on the surface. This is for the following reason. As the emboss radius increases, a contact area with a flat plate increases. Thus, adhesive wear during a sliding movement becomes heavy on the soft tin plating layer and the friction coefficient increases. On the other hand, on the tin-palladium alloy containing layer 1 having high hardness, even if the contact area becomes large, an increase of adhesive wear is suppressed. Thus, a difference in the friction coefficient between the tin-palladium alloy containing layer 1 and the tin plating layer becomes notable.

Further, a contact load applied to the contact portions of the terminal pair is preferably not lower than 2 N. This causes an oxide film formed on the surface of the tin part 12 exposed on the surface of the alloy containing layer 1 to be broken. Then, the soft tin part 12 in a metal state having low contact resistance is exposed on the outermost surface and contributes to electrical contact. Thus, high connection reliability is achieved. Note that if the contact load is below 2N, film resistance with high dependency on the contact load dominantly contributes to the contact resistance. If the contact load is not lower than 2 N, constriction resistance with low dependency on the contact load dominantly contributes to the contact resistance.

Furthermore, if the contact load is not lower than 5 N, the friction coefficient is effectively reduced. The friction coefficient tends to decrease with an increase in the contact load. If the case of the tin-palladium alloy containing layer 1 and the case of the tin plating layer are compared, the friction coefficient is easily affected by the embossed shape on the tin plating layer as described above and it may be difficult to reduce the friction coefficient even if a contact load of 5 N or higher is applied, but the friction coefficient is unlikely to be affected by the embossed shape on the tin-palladium alloy containing layer and the friction coefficient is effectively reduced if a load of 5 N or higher is applied. As just described, if the contact load of the terminal pair is set at 5 N or higher, it is possible to enjoy a notable friction coefficient reducing effect while satisfying high connection reliability.

Hereinafter, the embodiment is described in detail using examples.

<Example 1: Evaluation of Hardness and Friction Coefficient of Tin-Palladium Alloy Containing Layer>

(Fabrication of Samples)

A nickel under plating layer having a thickness of 1 μm was formed on a clean surface of a copper board and a palladium plating layer was formed on the nickel under plating layer. Subsequently, a tin plating layer was formed on the palladium plating layer. This was heated at 280° C. in the atmosphere, thereby forming a tin-palladium alloy containing layer and a plated member according to the example.

Here, the content of palladium in the tin-palladium alloy containing layer was specified by adjusting thicknesses of the tin plating layer and the palladium plating layer. Specifically, tin-palladium alloy containing layers having a palladium content of 1 atom %, 4 atom % and 7 atom % were formed by setting the thickness of the tin plating layer at 2 μm and setting the thickness of the palladium plating layer at 0.02 μm, 0.05 μm and 0.09 μm. Note that the content of palladium in the tin-palladium alloy containing layer was estimated by an energy dispersion X-ray spectroscopy (EDX).

A cross-section of each obtained plated member was observed by a scanning ion microscope (SIM) and a structure in which domains (alloy parts) made of a tin-palladium alloy are formed in a pure tin phase or in a metal phase substantially made of tin (tin part) was confirmed. Note that whether or not such a structure can be clearly observed largely depends on microscope observation conditions and the structure is studied in detail based on an observation result of a scanning electron microscope (SEM) of Example 2 to be described later in which clear images were obtained. However, a structure composed of the alloy parts and the tin part as in Example 2 was observed also in Example 1.

Further, only a tin plating layer having a thickness of 1 μm was formed on the nickel under plating layer on the copper base material, thereby forming a plated member according to a comparative example.

(Evaluation of Hardness of Tin-Palladium Alloy Containing Layer)

The hardness of each of three types of tin-palladium alloy plated members was measured using a Vickers hardness meter. The Vickers hardness was measured while a measurement load was increased for each plated member, and the hardness measured in a state where a measurement value of the hardness was not increased any further even if the measurement load was increased was set as the Vickers hardness of that plated member. The measurement load at that time was 25 mN when the content of palladium in the tin-palladium alloy containing layer was 1 atom % and 4 atom % and 50 mN when the content of palladium was 7 atom %.

Figure 2:
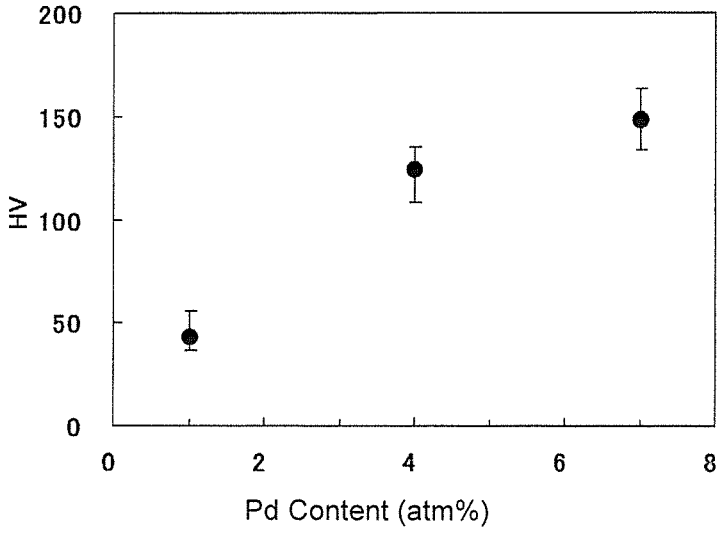
FIG. 2 is a graph showing Vickers hardness measured while the content of palladium in a palladium alloy was varied.

A measurement result of the Vickers hardness (Hv) in relation to the content of palladium is shown in FIG. 2. The Vickers hardness was 43 when the content of palladium in the tin-palladium alloy containing layer was 1 atom % while being increased to 124, which was about four times as high, when the content of palladium was 4 atom %. On the other hand, the Vickers hardness was 148 when the content of palladium was further increased to 7 atom %. Although the hardness was increased as compared with the case where the content of palladium was 4 atom %, a rate of increase was smaller than when the content of palladium was increased from 1 atom % to 4 atom %, which indicated a saturation tendency.

(Evaluation of Friction Coefficient)

A dynamic friction coefficient was evaluated as an index of a terminal insertion force for each of the plated members according to the example and the comparative example. That is, a flat plate-like plated member and an emboss-like plated member having a radium of 1 mm were brought into contact in a vertical direction and held, and the emboss-like plated member was pulled in a horizontal direction at a rate of 10 mm/min and a frictional force was measured using a load cell while a load of 3 N was applied in the vertical direction using a piezo actuator. The friction coefficient was obtained by dividing the frictional force by the load.

Figure 3A:
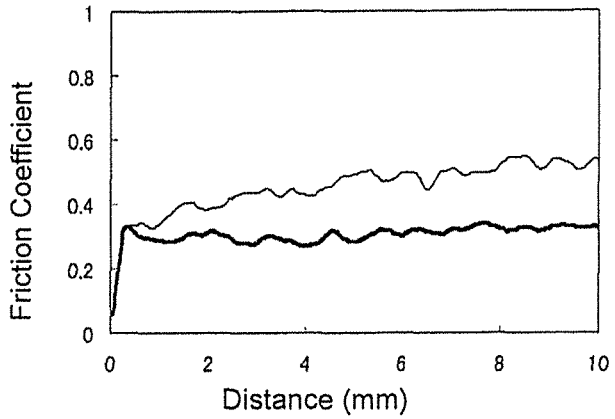
FIGS. 3(*a*), 3(*b*) and 3(*c*) are graphs showing friction coefficients measured while the content of palladium in the palladium alloy was varied, wherein the content of palladium is 1 atom % in FIG. 3(*a*), 4 atom % in FIG. 3(*b*) and 7 atom % in FIG. 3(*c*) and a thick line represents a friction coefficient of a plated member formed with a palladium alloy and a thin line represents a friction coefficient of a tin plated member in each figure.
Figure 3B:
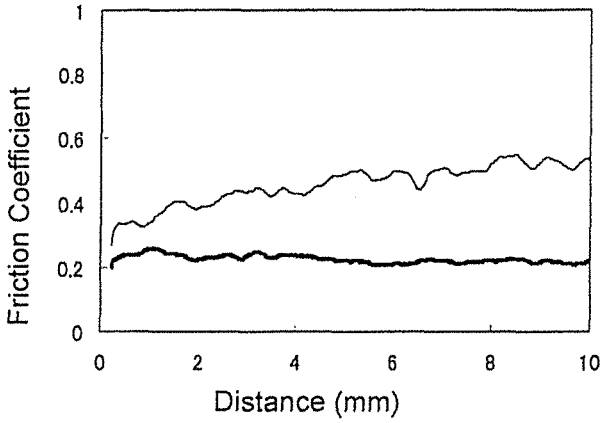
Figure 3C:
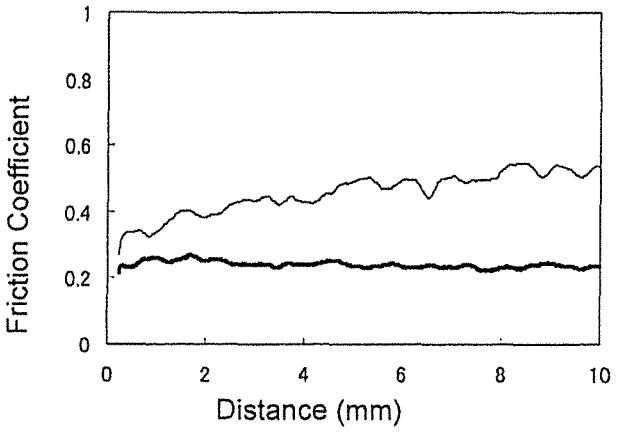

Measurement results of the friction coefficient measured while the composition of palladium was varied are shown in FIG. 3. In FIG. 3, a measurement result of each plated member formed with the tin-palladium alloy containing layer according to the example is shown by a thick line and that of the tin plated member according to the comparative example is shown by a thin line. When these results are seen, it is found that the friction coefficient is lower than that of the tin plated member regardless of the palladium content. This is thought to be because the tin-palladium alloy containing layer has high hardness.

The values of the friction coefficient in graphs are about 0.3 when the palladium content was 1 atom %, about 0.2 when the palladium content was 4 atom % and about 0.2 also when the palladium content was 7 atom %. When the palladium content was 4 atom % and 7 atom %, the friction coefficient was reduced to about half as compared with the case where only tin plating was applied.

Although the friction coefficient is reduced as the palladium content increases from 1 atom % to 4 atom %, a reduction of the friction coefficient shows a peaking tendency even if the palladium content is further increased from 4 atom % to 7 atom %. This behavior corresponds to an increasing tendency of the Vickers hardness with an increase in the palladium content. That is, an increase of the Vickers hardness is presumed to contribute as a main factor to a reduction of the friction coefficient.

As described above, it was revealed that the friction coefficient was reduced in the plated member formed with the tin-palladium alloy containing layer than in the tin plated member. However, the effect of reducing the friction coefficient is not largely improved even if more than 7 atom % of palladium is contained.

Evaluation of Structure and Contact Resistance Value of Tin-Palladium Alloy Containing Layer (Fabrication of Samples)

Similarly to the plated members according to Example 1, a plated member including a tin-palladium alloy containing layer was formed on a surface of a copper board. Also here, an exposed surface ratio of alloy parts was made different by varying a thickness of a palladium plating layer before heating. Specifically, three types of plated members having an exposed surface ratio of 12%, 45% and 78% were fabricated. These respectively correspond to 1 atom %, 4 atom % and 7 atom % in palladium content. Note that the exposed surface ratio of the alloy parts was calculated from an SEM image of a cross-section to be described later.

Also here, only a tin plating layer having a thickness of 1 μm was formed on a nickel under plating layer on a copper base material, thereby forming a plated member according to a comparative example.

(Evaluation of Structure)

A cross-section of each plated member according to the example was observed by an SEM and the structure thereof was evaluated.

Figure 4A:
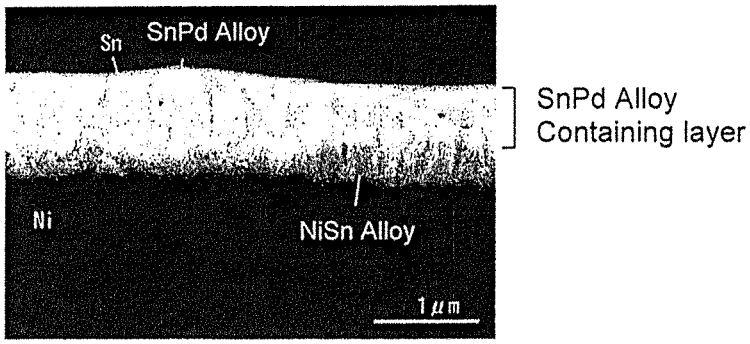
FIGS. 4(*a*), 4(*b*) and 4(*c*) show SEM images of cross-sections of plated members each formed with a tin-palladium alloy layer, wherein an exposed surface ratio of alloy parts is 12% in FIG. 4(*a*), 45% in FIG. 4(*b*) and 78% in FIG. 4(*c*).
Figure 4B:
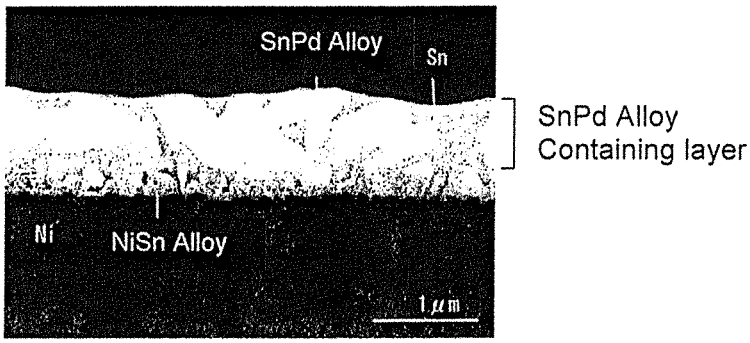
Figure 4C:
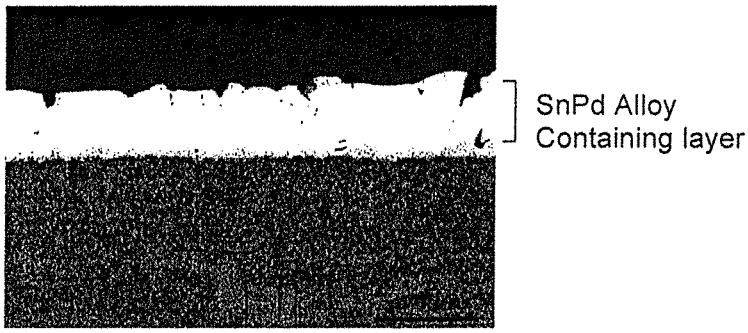

FIG. 4 show a cross-sectional SEM image of each plated member according to the example formed with a tin-palladium alloy containing layer. This reveals that a tin plating layer and the palladium plating layer formed on a nickel plating layer are alloyed by heating, thereby forming a single alloy containing layer.

It is notable when the exposed surface ratio is 12% (FIG. 4(*a*)) and 45% (FIG. 4(*b*)) that a multitude of long and narrow domain-like structures observed to be brighter than surroundings are present in the tin-palladium alloy containing layer. According to the result of EDX, these domain-like structures are parts made of tin-palladium alloy (alloy parts). Further, other parts constitute a pure tin phase or a metal phase (tin part) substantially made of tin.

Note that a thin layer having a thickness of about 0.3 to 0.5 μm and observed to be relatively bright is formed between a nickel layer and the tin-palladium alloy containing layer. This is thought to be a nickel-tin alloy layer.

According to a state phase diagram of a tin-palladium alloy, an intermetallic compound PdSn4 is stably present in an area where the content of palladium is below 20 atom %. Thus, the domain-like alloy parts observed above are estimated to have a composition of PdSn4.

(Evaluation of Glossiness)

Glossiness was measured at a measurement angle (θ) of 20° for each of the plated members according to the example and the comparative example in conformity with JIS Z 8741-1997. Four measurements were conducted for the same plated member and an average value thereof was obtained. The obtained glossiness is shown as a function in relation to the exposed surface ratio of the alloy parts estimated by the above SEM observation together with an approximation curve in FIG. 5. Further, the values of the glossiness are also shown in TABLE-1 below.

Figure 5:
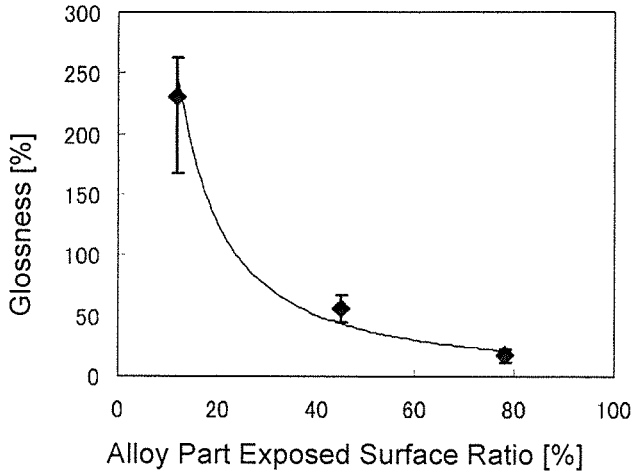
FIG. 5 is a graph showing a relationship of the exposed surface ratio of the alloy parts and surface glossiness.

According to FIG. 5, the glossiness of the surface decreases with an increase in the exposed surface ratio of the alloy parts. In addition, plot points are well approximated by a smooth approximation curve. That is, there is a highly monotonously decreasing correlativity between the exposed surface ratio of the alloy parts and the glossiness of the surface. Further, the glossiness measured for each plated member having a different exposed surface ratio, including a range of an error, is in a range of 10 to 300%.

(Evaluation of Contact Resistance)

A contact resistance value was evaluated by measuring a contact load-contact resistance characteristic for each of the plated members according to the example and the comparative example. That is, contact resistance was measured by a four-terminal method for each plated member. At this time, an open voltage was set at 20 mV, an applied current was set at 10 mA, a load applying speed was set at 0.1 mm/min and a load of 0 to 50 N was applied in an increasing direction and a decreasing direction. One electrode was in the form of a flat plate and the other was in the form of an emboss having a radius of 1 mm. This load-resistance characteristic was evaluated for the plated members in an initial state (immediately after fabrication). Contact resistance values measured at a load of 10 N were compared among the respective plated members.

The contact resistance value measured at a load of 10 N for each plated member according to the example is shown in TABLE-1. The glossiness and the friction coefficient of each plated member are also shown in TABLE-1. The friction coefficient is shown in a relative value based on the friction coefficient measured for the tin plated member according to the comparative example as 100%. Note that the values of the friction coefficient slightly differ from those of Example 1 due to a difference in the measurement load and unavoidable variations of plated member fabrication conditions and friction coefficient measurement conditions.

TABLE 1

| | Exposed Surface Ratio [%] | | |
|---|---|---|---|
| | 12 | 45 | 78 |
| Glossiness [%] | 231 | 55 | 18 |
| Contact Resistance [mΩ] | 0.79 | 0.76 | 1.0 |
| Friction Coefficient (Sn Plating Rate %) | 46 | 61 | 54 |

According to TABLE-1, the contact resistance value is 0.7 to 1.0 mΩ at any exposed surface ratio. The tin plating layer formed on the copper base material roughly shows contact resistance of about 0.5 to 1.0, but the plated members according to the example provide contact resistance comparable to this. Further, differences in the contact resistance value among the three types of plated members according to the example having different exposed surface ratios are very small. That is, at any of the exposed surface ratios, contact resistance suppressed to a low value comparable to that of the tin plated member is obtained.

Further, according to TABLE-1, the friction coefficient is largely reduced at any of the exposed surface ratios as compared with the tin plated member. From these results, both the effect of suppressing the contact resistance of the surface comparably to the tin plated member and the effect of reducing the friction coefficient more than the tin plated member can be simultaneously enjoyed by setting the exposed surface ratio of the tin part in the tin-palladium alloy containing layer in a range of 10 to 80% and setting the glossiness of the surface at 10 to 300%.

According to FIG. 4, domain dimensions of the alloy parts exposed on the outermost surface of the tin-palladium alloy are not longer than 1 μm. On the other hand, the substantial diameter of the contact portion formed between the emboss-like plated member and the flat plate-like plated member is about 100 μm. That is, the domain dimensions of the alloy parts are smaller than the diameter of the contact portion by two digits. This causes both the domains of a multitude of alloy parts and the tin part to be exposed in the contact portion and contribute to electrical contact. Thus, the suppression of the contact resistance and the reduction of the friction coefficient are effectively combined.

Figure 6:
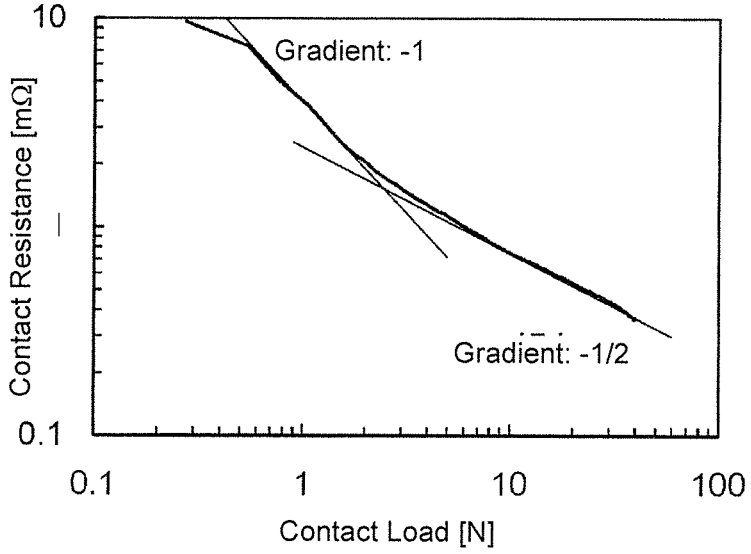
FIG. 6 is a graph showing a contact load-contact resistance characteristic in double logarithmic representation when the exposed surface ratio of the alloy parts is 45%.

Further, a contact load-contact resistance characteristic obtained when the exposed surface ratio of the alloy parts was 45% is shown in double logarithmic representation in FIG. 6 to estimate a minimum necessary contact load to obtain good electrical contact.

Main occurrence factors of contact resistance between conductors are divided into film resistance and constriction resistance. The film resistance is contact resistance that occurs due to the presence of an insulating film such as an oxide film formed on a conductor surface, and the constriction resistance is derived from microscopic unevenness of a conductor surface and caused by the flow of a current only by way of the position of true contact formed in a microscopic area out of a macroscopic (apparent) contact area. If a contact load is increased, the film resistance decreases due to physical destruction of the insulating film. That is, if a contact load necessary to break the insulating film is applied to a contact portion, electrical conduction can be established in a constriction resistance area without being substantially affected by the film resistance. The dependencies of the constriction resistance and the film resistance are already formulated using a model as described in Japanese Unexamined Patent Publication No. 2002-5141. According to that, in the case of bringing two conductors having a flat contact surface into contact, contact resistance Rk as the sum of constriction resistance and film resistance is expressed by the following Equation (1).

[Equation 1]

$$Rk = \frac{\rho}{2}\sqrt{\frac{\pi H}{KSF}} + \frac{H\rho_f d}{F} \tag{1}$$

Here, F denotes contact load, S denotes apparent contact area, K denote surface roughness, H denote hardness, ρ denotes metal resistivity, ρf denotes film resistivity and d denotes insulating film thickness.

In Equation (1), the first term on the right side represents the contribution of the constriction resistance and the second term represents the contribution of the film resistance. As can be understood from Equation (1), the constriction resistance exhibits dependency to the power of −½ on a contact load F, whereas the film resistance exhibits dependency to the power of −1 on the load F. That is, when the dependency of the contact resistance on the contact load is shown in double logarithmic representation, an area where the film resistance is dominant is supposed to be approximated by a straight line with a gradient of −1 and an area where the constriction resistance is dominant is supposed to be approximated by a straight line with a gradient of −½. At an intersection of the both straight lines, a switch is supposed to be made from the area where the film resistance is dominant to the area where the constriction resistance is dominant.

According to FIG. 6, an area which can be approximated by a straight line with a gradient of −1 is observed on a low load side and an area which can be approximated by a straight line with a gradient of −½ is observed on a high load side. These areas are thought to respectively correspond to the area where the film resistance is dominant and the area where the constriction resistance is dominant. An intersection of the both straight lines is obtained at 2 N. That is, if a contact load of at least 2 N is applied, the contribution of the film resistance having a large value and large load dependency is substantially eliminated and electrical contact is established in the constriction resistance area having a small value and small load dependency. Thus, by applying a contact load of 2 N or higher to the contact portion of the terminal pair, stable and good electrical contact having low contact resistance can be obtained.

Note that, when a contact load-contact resistance characteristic was similarly measured for the plated member according to the comparative example including only the tin plating layer and shown in double logarithmic representation, an area approximated by a straight line with a gradient of −1 on a low load side and an area approximated by a straight line with a gradient of −½ on a high load side were seen and an intersection of the both approximation straight lines was observed at 2 N also in this case. That is, the contact load that provides the intersection is the same between the tin-palladium alloy layer and the tin layer. This means that not the alloy parts, but the tin part is mainly responsive for electrical conduction on the surface of the tin-palladium alloy layer and low contact resistance mainly composed of constriction resistance of metal tin is obtained by destroying the oxide tin film covering the surface of the tin part.

<Example 3: Evaluation of Contact Resistance Increase Caused by Heating>

To estimate a degree of an increase in the contact resistance value associated with use under a heating environment, a degree of a contact resistance increase caused by heating was evaluated using the same samples used in Example 1. That is, contact resistance was measured by a four-terminal method under the same conditions as in the contact resistance measurement in Example 2 for each plated member in an initial state (immediately after fabrication). Subsequently, each plated member was left at 160° C. in the atmosphere for 120 hours (hereinafter, this condition may be referred to as "left at high temperature"). After the samples left at high temperature were cooled to room temperature, contact resistance was similarly measured. Focusing on a contact resistance value at a load of 10 N, a value increased from the initial state to the state left at high temperature was set as a resistance increase value.

TABLE-2 shows contact resistance values measured at a load of 10 N in the initial state (before being left at high temperature) and in the state after being left at high temperature and increase amounts of the contact resistance values for plated members formed with a tin-palladium alloy containing layer and a plated member formed with a tin plating layer according to the example and the comparative example.

TABLE 2

| | Pd Content/Atom % | | | |
|---|---|---|---|---|
| | 0 (tin Plating) | 1 | 4 | 7 |
| Initial Contact Resistance | 0.52 | 0.41 | 0.49 | 0.69 |
| Contact Resistance After Being Left at High Temperature | 1.42 | 1.22 | 1.46 | 1.42 |
| Contact resistance increase value caused by being left at high temperature | 0.90 | 0.81 | 0.97 | 0.73 |

(Unit: mΩ)

According to the result of TABLE-2, an increase of the contact resistance value caused by being left at high temperature was substantially comparable to that of the tin plated member in any one of three types of plated members formed with the tin-palladium alloy containing layer. That is, by forming the hard tin-palladium alloy containing layer on the surface, a phenomenon in which a degree of an increase of the contact resistance value caused by being left at high temperature becomes larger than that of the tin plated member does not occur. Note that a similar measurement was conducted also for a plated member formed with a tin-palladium alloy layer by setting a thickness of the tin plating layer before alloying at 1 μm instead of at 2 μm. An increase of the contact resistance value caused by being left at high temperature was substantially comparable to that of the tin plated member. Note that differences in the initial contact resistance from the case of Example 2 although the Pd content is located in areas overlapping those in the case of Example 2 are due to unavoidable variations of plated member fabrication conditions and friction coefficient measurement conditions.

<Example 4: Evaluation of Relationship Between Contact Portion Shape and Friction Coefficient>

The friction coefficient is affected not only by the configuration of the metal layer on the surface of the contact portion, but also by the shape of the contact portion constituting the terminal pair. Thus, the friction coefficient was measured while the contact portion shape was varied to estimate which shape of the contact portion of the terminal pair leads to an increase in the effect of reducing the friction coefficient by the tin-palladium alloy containing layer. That is, a male connector terminal including a flat plate-like terminal tab and a female connector terminal including an emboss-like contact portion were respectively formed using plated members with a Pd content of 1 atom %, 4 atom % and 7 atom % and a tin plated member formed as in Example 1. Then, the friction coefficient was measured as in the case of Example 1 for a case where both the male and female connector terminals were formed by the tin-palladium alloy plated members and a case where either one of them was formed by the tin-palladium alloy plated member. Here, there were three measurement loads of 3 N, 5 N and 10 N and two types of female connector terminals whose emboss radius (R) was 1 mm and 3 mm were used.

TABLE-3 shows the friction coefficient measured for each combination. Here, each friction coefficient is shown in a relative value with the friction coefficient measured when the male connector terminal and the female connector terminal were both formed by tin plated members set as 100%. Note that the values of the friction coefficients slightly different from those in the case of Example 1 and Example 2 are due to unavoidable variations of plated member fabrication conditions and friction coefficient measurement conditions.

TABLE 3

| | Pd | R = 1 mm | | | R = 3 mm | | |
|---|---|---|---|---|---|---|---|
| Type of Plating | Content | 3N | 5N | 10N | 3N | 5N | 10N |
| M: Sn—Pd Alloy Plating | 1% | 62 | 71 | 76 | **58** | **47** | **50** |
| F: Sn—Pd Alloy Plating | 4% | 68 | 91 | 90 | **81** | **61** | **58** |
| | 7% | 68 | 88 | 100 | **62** | **54** | **59** |
| M: Sn—Pd Alloy Plating | 1% | 62 | 75 | 83 | 98 | 75 | 79 |

TABLE 3-continued

| Type of Plating | Pd Content | R = 1 mm 3N | 5N | 10N | R = 3 mm 3N | 5N | 10N |
|---|---|---|---|---|---|---|---|
| F: Sn Plating | 4% | 66 | 77 | 86 | 100 | 85 | 92 |
| | 7% | 69 | 90 | 100 | 100 | 85 | 87 |
| M: Sn Plating | 1% | 70 | 93 | 100 | 70 | 58 | 64 |
| F: Sn—Pd Alloy Plating | 4% | 74 | 100 | 100 | 75 | 64 | 64 |
| | 7% | 74 | 93 | 84 | 70 | 59 | 61 |

*shown in ratio with friction coefficient measured when male and female connector terminals were both Sn plated terminals set as 100%

According to the result of TABLE-3, the friction coefficient is lower when the male and female connector terminals are both formed by the tin-palladium alloy plated members than when only either one of them is formed by the tin-palladium alloy plated member. Above all, low friction coefficients are obtained when the emboss radius is 3 mm as shown in boldface in TABLE-3. Focusing on the case where the emboss radius is 3 mm, the friction coefficient is lower when only the female connector terminal is formed by the tin-palladium alloy plated member than when only the male connector terminal is formed by the tin-palladium alloy plated member and a value close to that when the both are formed by the tin-palladium alloy plated members is obtained when only the female connector terminal is formed by the tin-palladium alloy plated member. That is, the effect of reducing the friction coefficient is found to be exhibited more when the tin-palladium alloy plating is applied to the emboss-like contact portion, particularly the one having a large radium of 3 mm or larger than when it is applied to the flat plate-like contact portion. Further, a particularly low friction coefficient is obtained when the measurement load (contact load) is not lower than 5 N in the case where the male and female connector terminals are both formed by the tin-palladium alloy plated members.

Note that TABLE-3 is shown in relative values based on a comparative example where the male and female connector terminals were both made by tin plated members. If an already low friction coefficient is obtained in this comparative example, it may not be possible to observe a significant difference in the friction coefficient within the range of measurement accuracy even if either one of them is formed by the tin-palladium alloy plated member. Such a case is written as "100%" in TABLE-3 and the value of the friction coefficient as an absolute value is sufficiently low for use as a connector terminal.

By the above, it became evident that the effect of reducing the friction coefficient was obtained while an increase in the contact resistance increase value caused by being left at high temperature was avoided by forming the tin-palladium alloy containing layer on the base material made of copper or copper alloy as compared with the case where the conventional tin plating layer was formed. It was found possible to combine the reduction of the friction coefficient and the suppression of the contact resistance by setting the exposed surface ratio of the alloy parts on the surface of the tin-palladium alloy layer at 10 to 80% and the glossiness of the surface at 10 to 300%. It was also found that stable contact resistance having a small value was easily obtained if the contact load at the contact portion was set at 2 N or higher and a particularly low friction coefficient was easily obtained if the contact load was set at 5 N or higher. It was further found that the effect of reducing the friction coefficient was easily obtained by applying the tin-palladium alloy layer to the female terminal including the emboss-like contact portion and setting the radius of the emboss at 3 mm.

Although the embodiment of the present invention has been described in detail above, the present invention is not limited to the above embodiment at all and various changes can be made without departing from the gist of the present invention.

The invention claimed is:

1. A plated terminal for connector, comprising:

a base material made of copper or a copper alloy; and an alloy containing layer carried on a surface of the base material, the alloy containing layer comprising a first metal phase made of an alloy of tin and palladium in a second metal phase made of pure tin or an alloy having a higher ratio of tin to palladium than in the first metal phase, the first metal phase and the second metal phase exposed on a surface of the alloy containing layer, and including an exposed surface ratio of the first metal phase to the second metal phase of 10% to 80%.

2. The plated terminal for connector of claim 1, wherein a content of palladium in the alloy containing layer is not lower than 1 atom %.

3. The plated terminal for connector of claim 2, wherein the content of palladium in the alloy containing layer is below 20 atom %.

4. The plated terminal for connector of claim 1, wherein the glossiness of the surface is in a range of 10 to 300%.

5. The plated terminal for connector of claim 1, wherein a thickness of the alloy containing layer is not smaller than 0.8 μm.

6. The plated terminal for connector of claim 1, wherein a dynamic friction coefficient when surfaces of the alloy containing layers are rubbed against each other is not higher than 0.4.

7. The plated terminal for connector of claim 1, wherein a Vickers hardness of the alloy containing layer is not lower than 100.

8. The plated terminal for connector of claim 1, wherein a domain of the first metal phase having a dimension shorter than the longest one of straight lines crossing a contact portion to be brought into electrical contact with another electrically conductive member is exposed on a surface of the contact portion.

9. The plated terminal for connector of claim 1, wherein the contact portion is in the form of an emboss.

10. The plated terminal for connector of claim 1, wherein a radius of the emboss is not smaller than 3 mm.

11. A terminal pair, comprising a male connector terminal and a female connector terminal, wherein at least one of the male and female connector terminals is formed by a plated terminal for connector of claim 1.

12. The terminal pair of claim 11, wherein a contact load applied to a contact portion where the male and female connector terminals come into contact with each other is not lower than 2 N.

13. The terminal pair of claim 12, wherein the contact load is not lower than 5 N.

14. The plated terminal for connector of claim 1, wherein a content of palladium in the alloy containing layer is between 1 atom % and 7 atom %.

15. A plated terminal for connector, comprising:

a base material carrying an alloy containing layer, the alloy containing layer comprising a first metal phase made of an alloy of tin and palladium in a second metal phase made of pure tin or an alloy having a higher ratio of tin to palladium than in the first metal phase, the alloy containing layer including a surface composition that includes an exposed surface ratio of the first metal phase to the second metal phase of 10% to 80%.

16. The plated terminal of claim 15, wherein the base material comprises a layer of copper or a copper alloy.

17. The plated terminal of claim 16, wherein the base material comprises a surface layer of nickel.

18. The plated terminal of claim 15, wherein the alloy containing layer includes a nickel tin alloy layer adjacent to the base material.

19. The plated terminal of claim 15, wherein a content of palladium in the alloy containing layer is between 1 atom % and 7 atom %.

* * * * *